US006059362A

United States Patent [19]

Lin

[11] Patent Number: 6,059,362

[45] Date of Patent: May 9, 2000

[54] ADJUSTABLE WAIST SUPPORT DEVICE FOR CHAIRS

[76] Inventor: Chung Ming Lin, No. 1008, Feng Lin 2nd Road, Ta Liao Hsiang, Kaohsiung Hsien, Taiwan

[21] Appl. No.: 09/291,206

[22] Filed: Apr. 14, 1999

[51] Int. Cl.[7] ..... A47C 7/42

[52] U.S. Cl. ..... 297/284.5; 297/284.7; 297/284.4

[58] Field of Search ..... 297/284.4, 284.5, 297/284.7, 300.2, 353, 343

[56] References Cited

U.S. PATENT DOCUMENTS

| | | | |
|---|---|---|---|
| 3,463,544 | 8/1969 | Froelich | 297/284.7 |
| 4,018,166 | 4/1977 | Gutridge et al. | 297/353 |
| 4,632,454 | 12/1986 | Naert | 297/284.7 |
| 4,676,550 | 6/1987 | Neve De Mevergnies | 297/353 |
| 4,730,871 | 3/1988 | Sheldon | 297/284.7 X |
| 5,791,733 | 8/1998 | Van Hekken et al. | 297/284.7 |
| 5,871,258 | 2/1999 | Battey et al. | 297/300.2 X |

FOREIGN PATENT DOCUMENTS

| | | |
|---|---|---|
| 174176 | of 1991 | Switzerland . |
| 347681 | of 1998 | Switzerland . |

*Primary Examiner*—Anthony D. Barfield
*Attorney, Agent, or Firm*—Bacon & Thomas, PLLC

[57] ABSTRACT

An adjustable waist support device that includes a waist support seat, a waist support fixed to the waist support seat, and an attachment device for mounting the waist support seat to a backrest of the chair. The waist support seat includes a longitudinal slot in a mediate portion thereof. The attachment device includes a plate, at least two washers, at least two elastic members, at least two screws, and at least two nuts. Each washer includes a reduced section so as to be slidingly extended through the longitudinal slot. Each elastic member is mounted to an associated washer. Each screw is extended through an associated elastic member, an associated washer, the longitudinal slot, a backboard of the backrest, and the plate in sequence and then secured in place by an associated nut.

2 Claims, 3 Drawing Sheets

ADJUSTABLE WAIST SUPPORT DEVICE FOR CHAIRS

BACKGROUND OF THE INVENTION

1. Field of the Invention

The present invention relates to a chair structure, and more particularly to an adjustable waist support device for chairs.

2. Description of the Related Art

Conventional adjustable waist support devices for chairs, e.g., Taiwan Utility Model publication No. 174176 entitled "Adjustable Waist Pad Structure for Chairs" issued on Dec. 1, 1991 and Taiwan Utility Model Publication No. 347681 entitled "Adjustable Backrest Pad Structure" issued on Dec. 11, 1998, are featured by adjusting the curvature of the waist support. The advantage of adjusting the curvature of the waist support resides in providing the most comfortable support to the user's waist for a long time to lower the risk of sore and pain and even injury to the user's waist. Nevertheless, a typical office chair may be adjusted to be inclined rearward such that the waist area may be offset from the best supporting location of original design. Thus, the user cannot be provided with the best support in the waist.

The present invention is intended to provide an adjustable waist support device for chairs that mitigates and/or obviates the above problem of conventional adjustable waist support devices.

SUMMARY OF THE INVENTION

It is a primary object of the present invention to provide an adjustable waist support device for chairs, wherein the position of the adjustable waist support device relative to the backrest is adjustable in a longitudinal direction.

In order to achieve the above object, the present invention provides an adjustable waist support device that includes a waist support seat, a waist support fixed to the waist support seat, and an attachment means for mounting the waist support seat to a backrest of the chair. The waist support seat includes a longitudinal slot in a mediate portion thereof. The attachment means includes a plate, at least two washers, at least two elastic members, at least two screws, and at least two nuts. Each washer includes a reduced section so as to be slidingly extended through the longitudinal slot. Each elastic member is mounted to an associated washer. Each screw is extended through an associated elastic member, an associated washer, the longitudinal slot, a backboard of the backrest, and the plate in sequence and then secured in place by an associated nut.

By this arrangement, the waist support seat is vertically slidable relative to the screws and can be held by the attachment means in a position which is deemed to be the best location for supporting the user's waist. The adjustable waist support device for chairs in accordance with the present invention allows vertical adjustment of the waist support relative to the backrest even if the user's waist relative to the backrest is changed as a result of lying backward, thereby providing the most comfortable support to the user's waist.

Other objects, specific advantages, and novel features of the invention will become more apparent from the following detailed description and preferable embodiments when taken in conjunction with the accompanying drawings.

DETAILED DESCRIPTION OF THE PREFERRED EMBODIMENT

Figure 1:
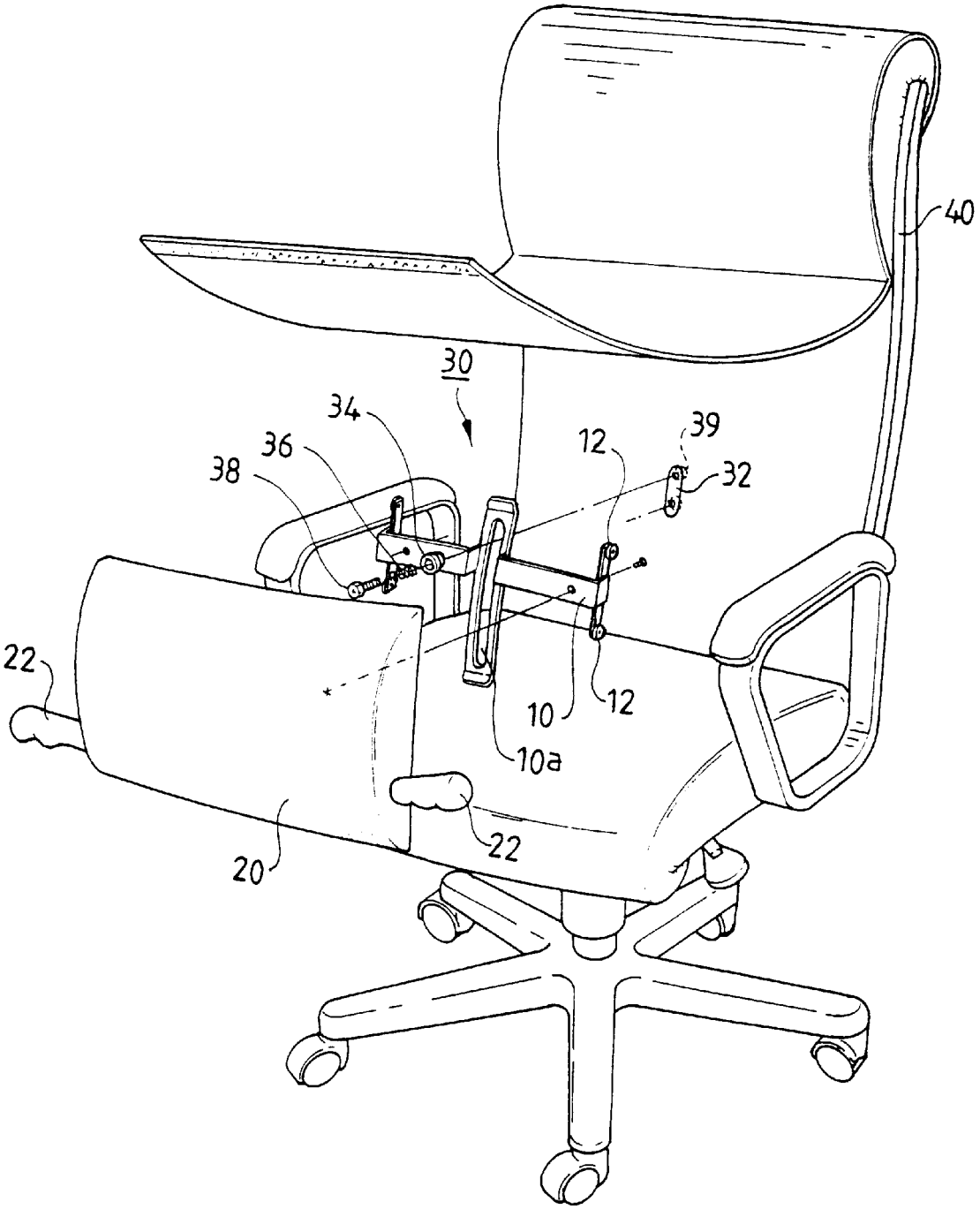
FIG. 1 is a perspective view, partly exploded, of a chair with an adjustable waist support device in accoordance with the present invention.
Figure 3:
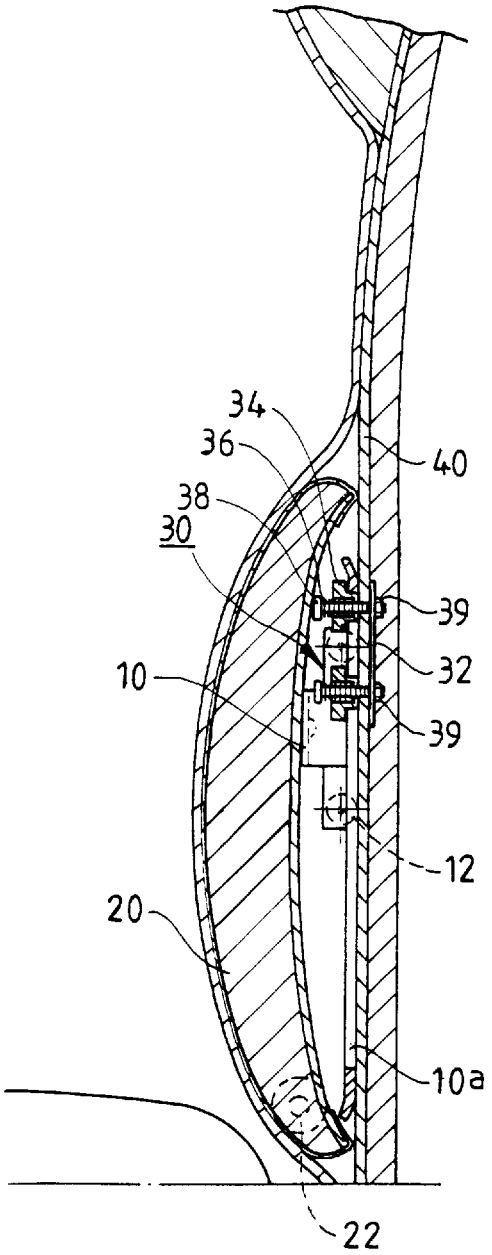
FIG. 3 is a sectional view taken along line 3—3 in FIG. 2.

FIG. 1 is an exploded view of an adjustable waist support device in accordance with the present invention applied to a chair. The adjustable waist support device includes a waist support seat 10, a waist support 20 fixed to the waist support seat 10, and an attachment means 30 for mounting the waist support seat 10 to a backrest of the chair. The waist support seat 10 includes a longitudinal slot 10*a* in a mediate portion thereof Referring to FIGS. 1 and 3, the attachment means 30 includes a plate 32, two washers 34, two elastic members 36, two screws 38, and two nuts 39. Each washer 34 includes a reduced section so as to be slidingly extended through the longitudinal slot 10*a*. Each elastic member 36 is mounted to an associated washer 34. Each screw 38 is extended through an associated elastic member 36, an associated washer 34, the longitudinal slot 10*a*, a backboard 40 of the backrest, and the plate 32 in sequence and then secured in place by an associated nut 39. The waist support seat 10 includes a number of wheels 12 mounted thereto and two handles 22 attached to two lateral sides thereof, respectively.

Figure 2:
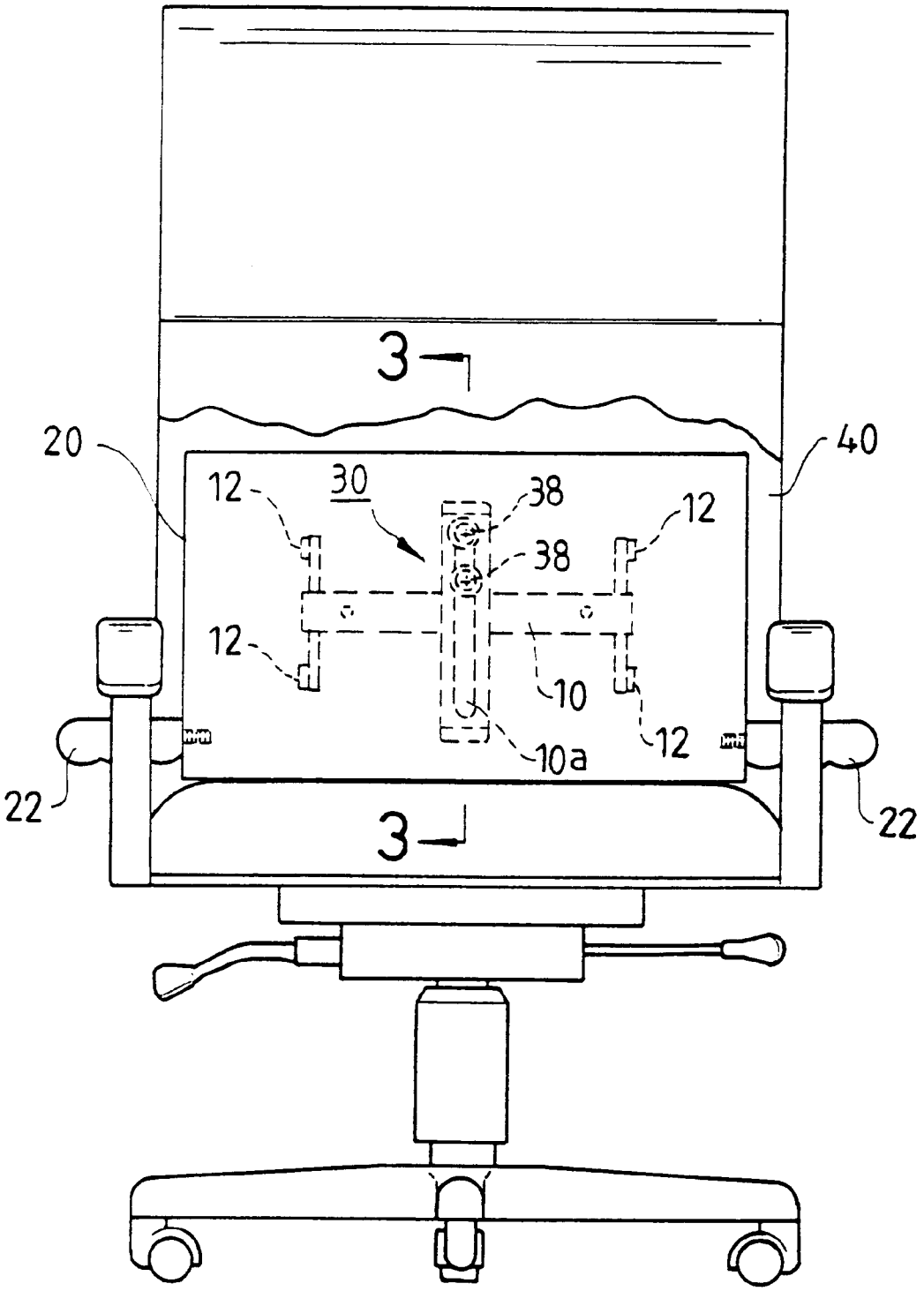
FIG. 2 is a front view of the chair with an adjustable waist support device in accordance with the present invention.
Figure 4:
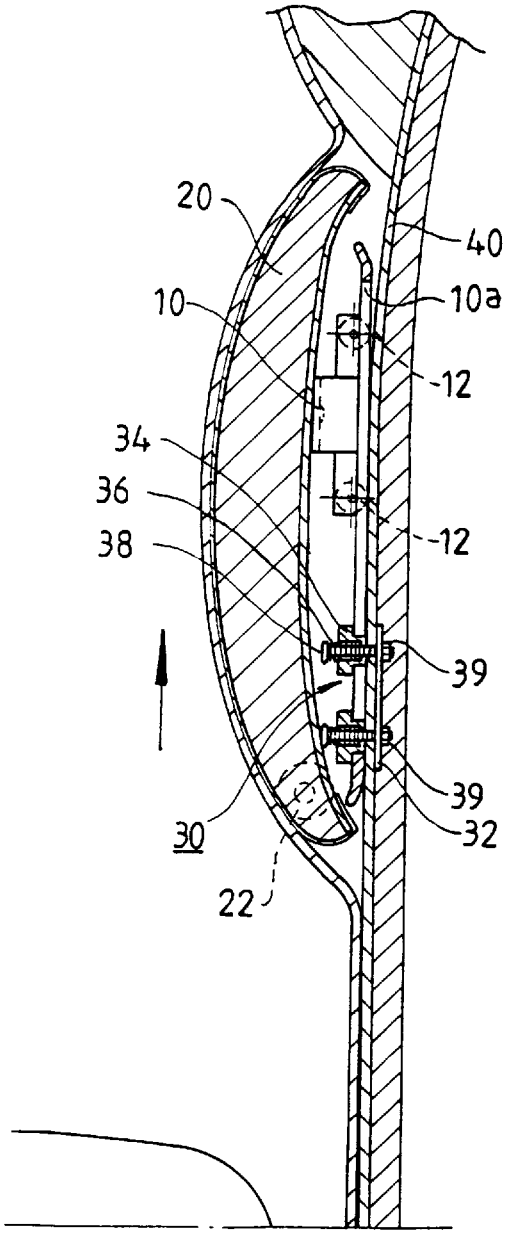
FIG. 4 is a sectional view similar to FIG. 3, illustrating adjustment of the waist support.

FIG. 2 is a front view of the chair equipped with the adjustable waist support device in accordance with the present invention. The attachment means 30 is secured to the backboard 40 of the backrest by the screws 38 and nuts 39. Lateral movement of the waist support seat 10 is prohibited since the screws 38 extend through the longitudinal slot 10*a*. In addition, the waist support seat 10 is held in place by the attachment means 30. This is because each elastic member 36 is compressed between the head of the associated screw 38 and the associated washer 34 when the associated screw 38 is secured in place by the associated nut 39, thereby bearing against the associated washer 34 to provide the required holding effect. Accordingly, when in use, the waist support seat 10 is vertically slidable relative to the screws 38 (see FIGS. 3 and 4) and can be held by the attachment means 30 in a position which is deemed to be the best location for supporting the user's waist.

Referring to FIG. 2, provision of the wheels 12 allows the waist support seat 10 to move smoothly even if the waist support seat 10 is under pressure, e.g., when the user that sits in the chair with his/her back lying against the backrest intends to adjust the position of the waist support 20. In addition, provision of the handles 22 allows easier adjustment of vertical position of the waist support 20.

According to the above description, it is appreciated that the adjustable waist support device for chairs in accordance with the present invention allows vertical adjustment of the waist support relative to the backrest even if the user's waist relative to the backrest is changed as a result of lying backward, thereby providing the most comfortable support to the user's waist.

Although the invention has been explained in relation to its preferred embodiment as mentioned above, it is to be understood that many other possible modifications and variations can be made without departing from the spirit and scope of the invention. It is, therefore, contemplated that the appended claims will cover such modifications and variations that fall within the true scope of the invention.

What is claimed is:

1. An adjustable waist support device for a chair with a backrest having a backboard, the device comprising:

a) a waist support seat including a longitudinal slot in a mediate portion thereof;

b) a plurality of wheels attached to the waist support seat;

c) a waist support fixed to the waist support seat; and d) an attachment means for slidably mounting the waist support to the backboard of the backrest, wherein the waist support may vertically slide along the backrest through engagement of the wheels against the backrest for disposing the waist support at a selected position, the attachment means including a plate, at least one washer having a reduced section slidingly extended through the longitudinal slot, at least one elastic member mounted to said at least one washer, and at least one screw and at least one nut, said at least one screw being extended through said elastic member, said washer, said longitudinal slot and said plate, and secured to said plate by said nut.

2. The adjustable waist support device of claim 1, wherein the waist support further includes two lateral sides, and a pair of handles extending from said lateral sides.

* * * * *